US005259806A

United States Patent [19]

Chang

[11] Patent Number: 5,259,806

[45] Date of Patent: Nov. 9, 1993

[54] MOBILE MUSICAL HULA DANCING DOLL

[76] Inventor: Kou-Cheng Chang, 98-023 Hekaha St., Bldg. 1, Unit 11, Aiea, Hi. 96701

[21] Appl. No.: 937,148

[22] Filed: Aug. 31, 1992

[51] Int. Cl.[5] ..... A63H 5/00; A63H 3/20; A63H 17/25; A63H 29/00

[52] U.S. Cl. ..... 446/270; 446/278; 446/288; 446/291; 446/298; 446/441

[58] Field of Search ..... 446/270, 272, 278, 279, 446/280, 288, 289, 290, 291, 292, 298, 303, 352, 353, 437, 441

[56] References Cited

U.S. PATENT DOCUMENTS

| | | | |
|---|---|---|---|
| 1,415,344 | 5/1922 | Haskell | 446/353 |
| 1,422,855 | 7/1922 | Haskell | 446/353 |
| 1,423,383 | 7/1922 | Zaiden | 446/353 |
| 1,452,134 | 4/1923 | Zaiden | 446/353 |
| 1,746,056 | 2/1930 | Sessler | 446/288 |
| 2,091,872 | 8/1937 | Muller | 446/437 |
| 3,512,300 | 5/1970 | Thoreson | 446/289 |
| 4,545,775 | 10/1985 | Kim | 446/353 |
| 4,573,939 | 3/1986 | Hoshino | 446/298 |
| 4,573,943 | 3/1986 | Kennedy et al. | 446/463 |
| 4,801,285 | 1/1989 | Yeu | 446/298 |
| 4,824,416 | 4/1989 | Chun-Hoi et al. | 446/298 |
| 4,875,886 | 10/1989 | Sung | 446/298 |

FOREIGN PATENT DOCUMENTS

| | | | |
|---|---|---|---|
| 0444456 | 3/1936 | United Kingdom | 446/437 |

*Primary Examiner*—Robert A. Hafer
*Assistant Examiner*—Gregory Stone
*Attorney, Agent, or Firm*—George W. T. Loo

[57] ABSTRACT

A hula dancing doll which alternately moves its hips left and right while making a forward or turning motion on a performance stage and a Hawaiian melody is heard to give a lifelikeness that compares with a real hula dancer. The doll includes a body portion, a hip portion, and a base portion. The body portion resembles the head through waist of a human; the hip portion resembles the hip portion of a human. The body portion includes a conical housing with a base, a switch, a battery, a motor, a melody I. C., a speaker, a drive gear, a cam, a push rod, a rack gear, a hip gear, a drive wheel gear, two front wheels connected to an axle, two rear wheels connected to an axle, a shaft is connected at one end to the drive wheel gear and at the other end to a turning drive wheel. When the switch is turned on, the drive gear will turn the cam and drive wheel gear. The cam will move upward the push rod and the rack gear to turn the hip gear. The drive wheel gear will drive the rear wheels forward, while the turning drive wheel is in a free wheeling position. When the front wheels go on the edge of a flat surface, the turning drive wheel will contact the flat surface and turn the front wheels away from the edge and back onto the flat surface.

3 Claims, 4 Drawing Sheets

MOBILE MUSICAL HULA DANCING DOLL

BACKGROUND OF THE INVENTION

1. Field of Invention

This invention relates to dancing hula dolls.

2. Description of the Prior Art

Hula dolls alternatively move their hips left and right while slowly turning counterclockwise and a Hawaiian melody is heard.

3. Disclosure Statement

Yeu, U.S. Pat. No. 4,801,285, issued Jan. 31, 1989, discloses a dancing hula doll with a three-way switch that alternatively moves its hips left and right while slowly turning counterclockwise and a Hawaiian melody is heard. An actuator arm 33 is connected at one end 34 to the right side of hips 6 and at its other end 35 to cam 54 so that the circular motion of cam 54 will be converted into up-and-down motion of actuator arm 33. The up-and-down motion of actuator arm 33 results in left-and-right motion of hips 6. When the three-way switch is turned on to the second position, the motor 36 turns cam 54 that in turn moves actuator arm 33 alternately up and down that in turn moves hips 6 left and right while the doll slowly turns counterclockwise and a Hawaiian melody is heard.

My invention is a dancing hula doll which swings its hips left and right along with a Hawaiian melody while freely rolling forward on a flat surface. The hips are moved in a different way and in a more efficient manner than the dancing hula doll of Yeu because of the use of hip gear 8 and rack gear 14 and cam 24. My doll moves its hips in a different way so that it is not the equivalent to the doll of Yeu. When operated with a specially designed performance stage, my dancing hull doll can roll in an expected hula dancing path.

SUMMARY OF THE INVENTION

This invention relates to a dancing doll that is free to roll forward on a flat surface and swing its hips left and right along with a Hawaiian melody. When operated with a specially designed performance stage, it can roll in an expected hula dancing path.

An object of this invention is to provide a hula dancing doll which moves as if it is actually dancing a hula dance.

Another object of this invention is to provide a hula dancing doll with a specially designed performance stage that will move in an expected hula dancing path.

A further object of this invention is to provide a hula dancing doll which becomes a hula dancer that moves as if it were actually dancing when battery power is turned on.

Still another object of this invention is to provide a lifelike hula dancing doll which is free to move around on a performance stage and makes turns that portray the turns in a hula dance.

A still further object of this invention is to provide a hula dancing doll that has the lifelike mobility of a real hula dancer.

Other objects, features and advantages of the present invention will be readily apparent from the following detailed description taken in connection with the accompanying drawings.

DESCRIPTION OF THE PREFERRED EMBODIMENT

Before explaining the present invention in detail it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not limitation.

Figure 1:
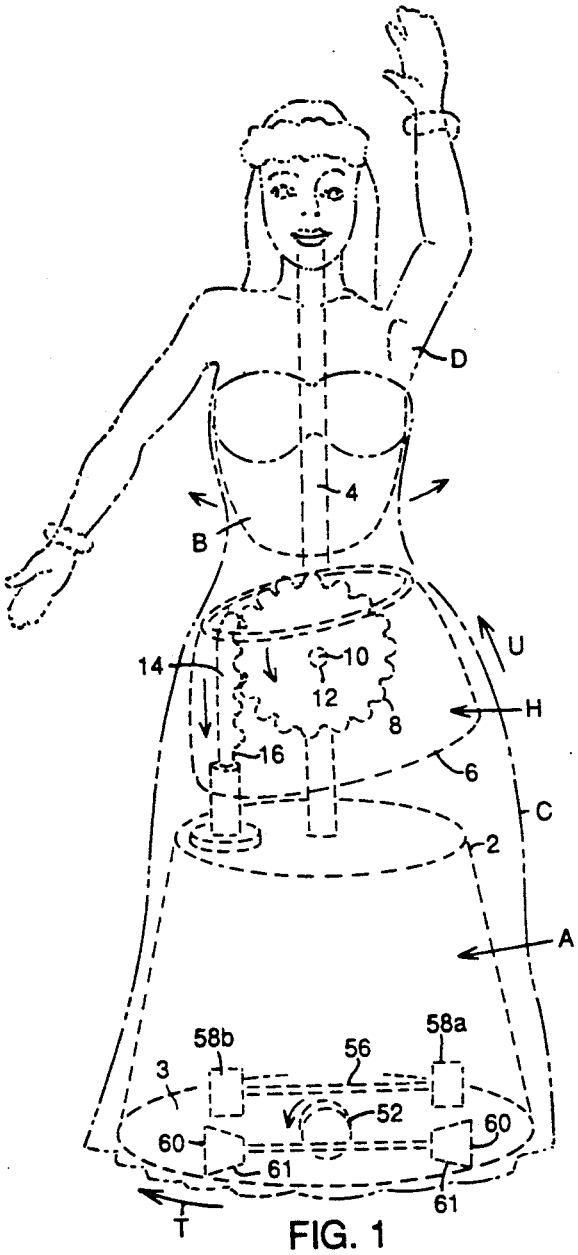
FIG. 1 is a front elevational view of the mobile musical hula dancing doll showing turning rotation.
Figure 2:
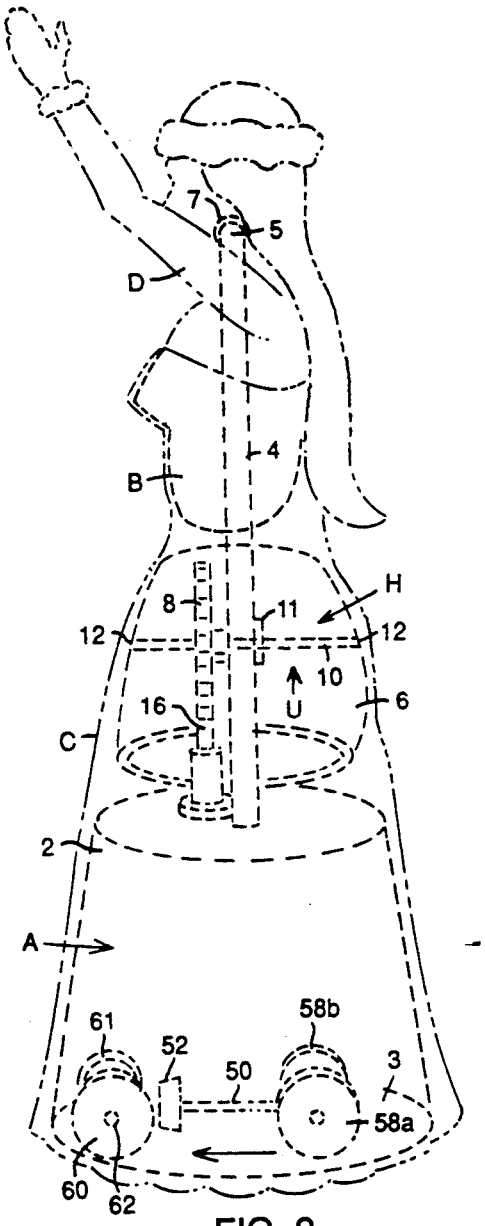
FIG. 2 is a right elevational view of FIG. 1 showing forward motion.
Figure 4:
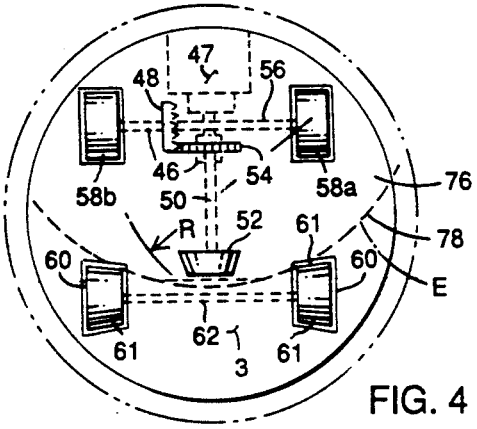
FIG. 4 is a schematic view showing rear drive wheels, front wheels on the edge of a flat surface, and turning drive wheel in position to turn the doll.
Figure 3:
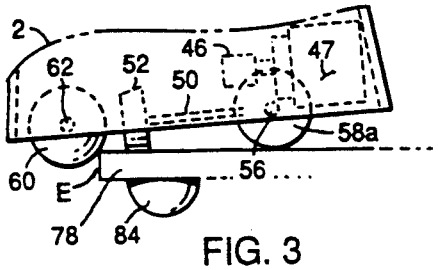
FIG. 3 is a partial side elevational view of the mobile musical hula dancing doll showing front wheels off edge and turning wheel in contact with surface.
Figure 5:
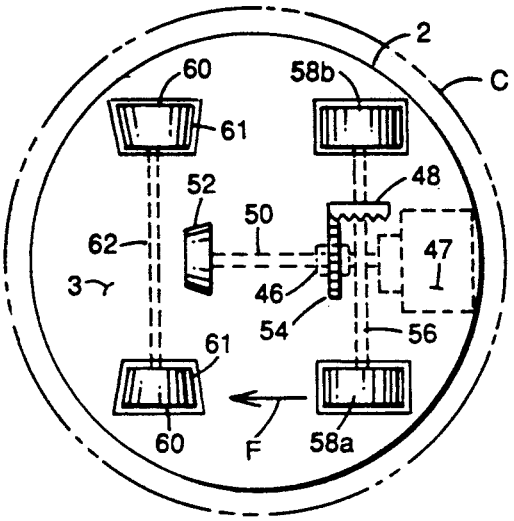
FIG. 5 is a schematic view thereof showing rear drive wheels and front wheels engaged in forward motion, with turning drive wheel in free wheeling position.
Figure 6:
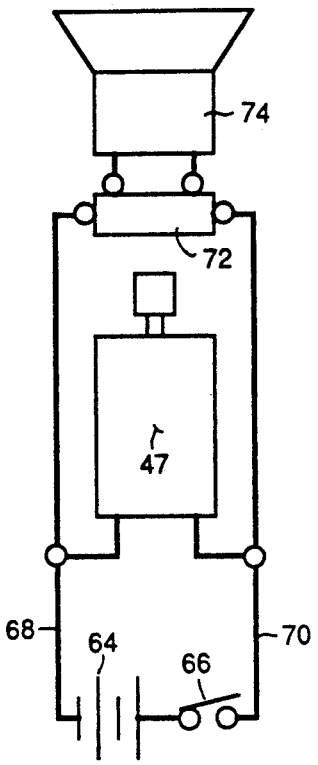
FIG. 6 is an electrical schematic view of mobile musical hula dancing doll.
Figure 7:
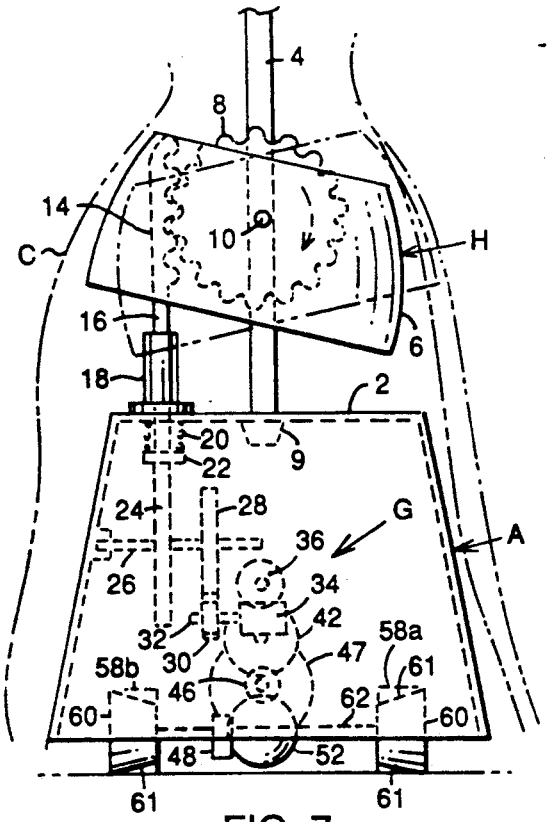
FIG. 7 is a partial front elevational view of mobile musical hula dancing doll mechanical parts showing cam in high position with doll's right hip in the upward position.
Figure 8:
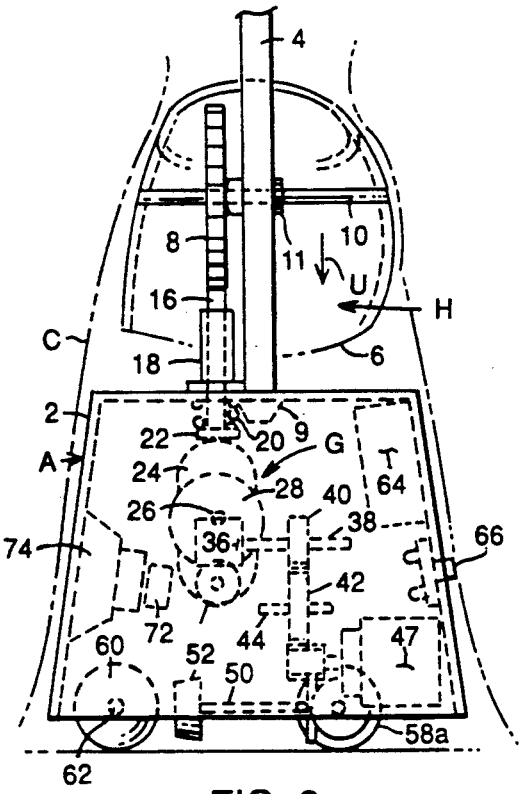
FIG. 8 is a partial right elevational view of mobile musical hula dancing doll of FIG. 7 showing electrical parts in position.
Figures 9A, 9B:
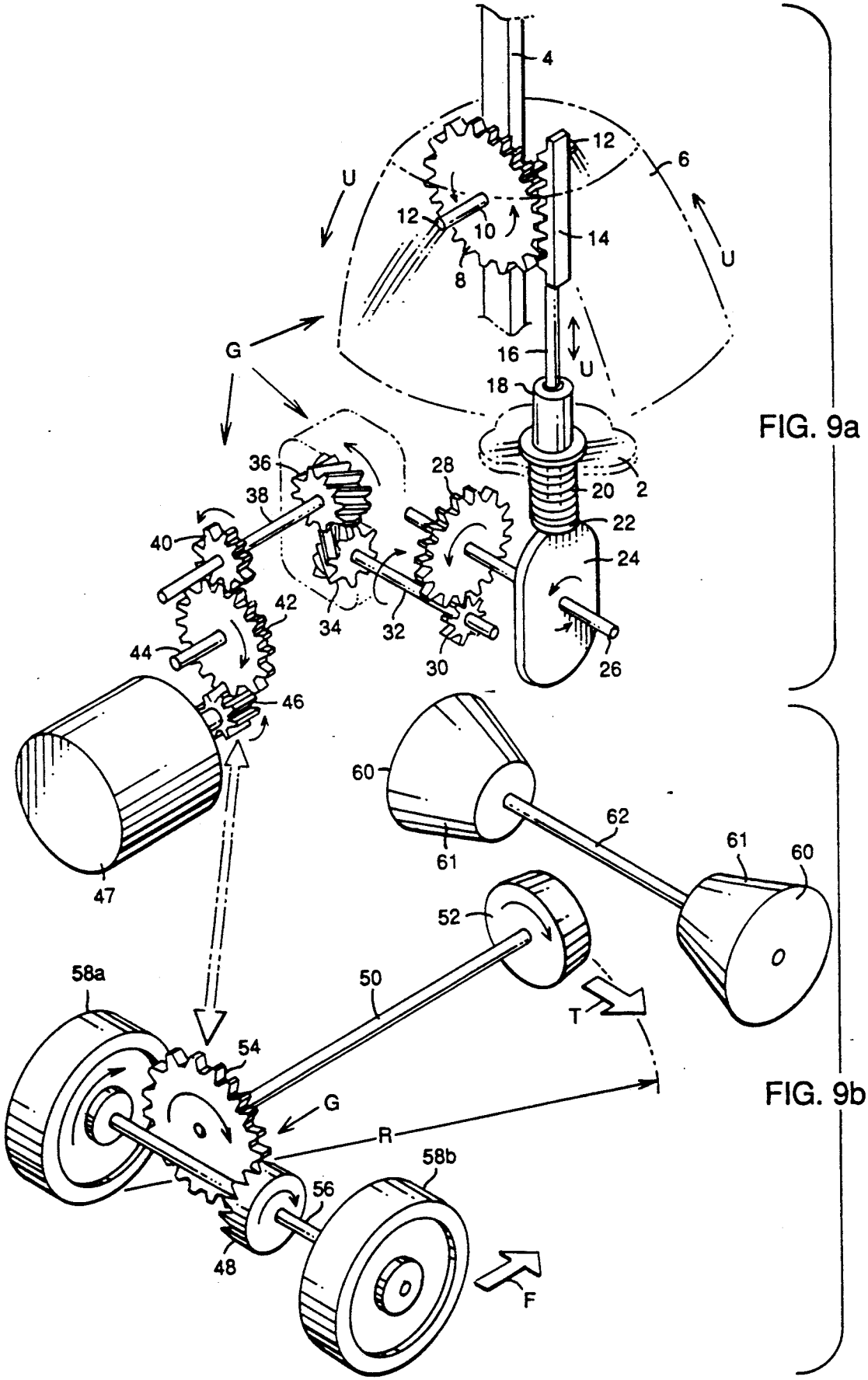
FIG. 9*a* is an enlarged exploded perspective schematic view of mobile musical hula dancing doll showing the mechanical drive train for hip movement.
FIG. 9*b* is an enlarged exploded perspective schematic view of mobile musical hula dancing doll showing the mechanical drive train for forward and turning motions.
Figure 10:
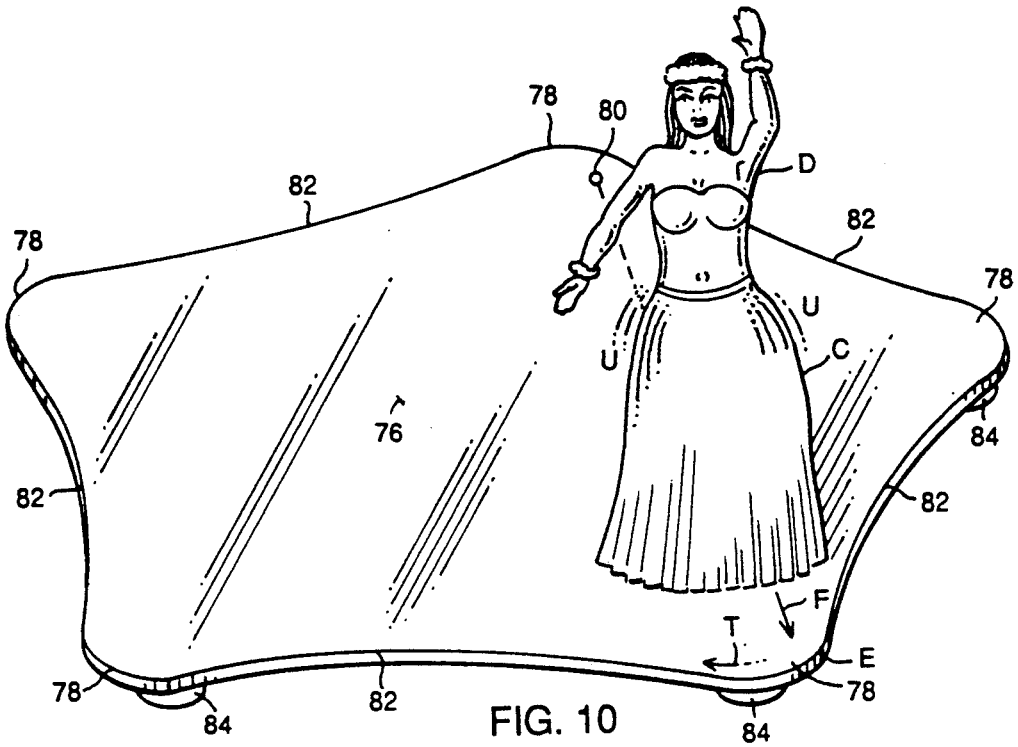
FIG. 10 is a front perspective view of mobile musical hula dancing doll moving on a rounded pentagonal performance stage.

Referring now to the drawings wherein like reference numerals and letters refer to like and corresponding parts throughout the several views, the preferred embodiment of the invention disclosed in FIGS. 1–11 inclusive is a mobile musical hula dancing doll D, hereinafter referred to a "doll D". Doll D includes a body portion B, a hip portion H, and a base portion A. Costume C covers doll D as shown in FIGS. 1, 2 and 10.

Body portion B resembles the head through waist of a human. Hip portion H resembles the hip portion of a human and has a human like hip movement through the use of hip gear 8. Base portion A supports the body portion B and the hip portion H by support post 4, one end of which is secured to conical housing 2 by support post attachment 9 and the other end, attaching area 5, is placed within socket 7. By snapping socket 7 onto attaching area 5, body portion B is locked in a tight, firm, and stable position to support post 4, which allows body portion B to sway slightly with hip action. Base portion B provides the weighted foundation, mobility, music, and the driving power to hip gear 8. Hip portion H is spaced from the top of base portion A a predetermined distance to allow the alternate movements of hips 6 to the left and to the right. See FIGS. 1 and 2.

Hip portion H includes hips 6, hip shaft 10, washer 11, shaft attachments 12, rack gear 14 and push rod 16. Hip shaft 10 passes through support post 4 and is pivotally attached to hips 6 at shaft attachments 12. Hip gear 8 is pivotally fixed on hip shaft 10 on one side of support post 4 and washer 11 is fixed on hip shaft 10 on the other side of support post 4. Washer 11 stops hips 6 from sliding forward. Hip gear 8 is in mesh with rack gear 14. One end of push rod 16 is secured to one end of rack gear 14 and the other end is secured to push rod head 22. When driving power is transferred by rack gear 14 to hip gear 8, hip gear 8 and hips 6 move pivotally around hip shaft 10.

Base portion A includes conical housing 2, base 3, support sleeve 18, spring 20, push rod head 22, cam 24, cam shaft 26; cam drive gear 28, transfer drive gear 30, shaft 32, lower helical transfer gear 34, upper helical transfer gear 36, shaft 38, transfer gear 40, spacer gear 42, shaft 44, motor drive gear 46, motor 47, axle drive gear 48, shaft 50, turning drive wheel 52, drive wheel gear 54, axle 56, rear drive wheel 58*a*, rear free moving wheel 58*b*, front wheels 60, front wheel tapers 61, axle 62, battery 64, switch 66, negative lead wires 68, positive lead wires 70, I. C. Electronic Melody Circuit Sound Module 72, and speaker 74. When switch 66 is turned on, Hawaiian music is heard and motor 47 is turned on.

The rear drive wheel 58*a* is pivotally mounted to axle 56. This allows rear drive wheel 58*a* to haul the weight and move doll D forward. The rear free moving wheel 58*b* is free but is pivotally mounted on axle 56. It provides balance to doll D. The rear free moving wheel 58*b* is not a drive wheel in the forward motion of doll D. But in turning motion, rear free moving wheel 58*b* allows turning drive wheel 52 and rear drive wheel 58*b* to make a turn without interruption. The front wheels 60 are also not drive wheels. They provide the balance to doll D. During the forward motion, the turning drive wheel 52 is in its free wheeling position and has a clear space from a surface. See FIGS. 7 and 8.

Support sleeve 18 is secured to the top of conical housing 2. Push rod 16 passes through support sleeve 18. Spring 20 is mounted on push rod 16 with one end abutting push rod head 22 and the other end abutting the top of conical housing 2. The push rod head 22 is kept in contact with cam 24 by the tension force of spring 20.

Reference letter E denotes the edge of a surface. Reference letter F denotes forward motion. Reference letter T denotes turning motion. Reference letter U denotes up/down motion. Reference letter G denotes motor drive and gear assembly.

FIG. 10 shows doll D on performance stage 76. Performance stage 76 includes starting point 80, five turning paths or angles 78, five blended areas 82, and five feet 84. The radius for the five turning paths 78 is equal to the radius R which is measured from turning drive wheel 52 to rear drive wheel 58*a*. See FIG. 9*b*.

The height of edge E must be greater than the distance of turning drive wheel 52 from the surface when it is in its free wheeling position in order to allow front wheels 60 to climb back on the surface after going on edge E. See FIG. 3. This allows turning drive wheel 52 to perform its turning function. When front wheels 60 go on the edge E of a flat surface, turning drive wheel 52 contacts the flat surface and turns front wheels 60 away from the edge and back on the flat surface. If the height of edge E is less, the turning function will not occur.

The rounded pentagonal performance stage 76, with five turning paths or angles, is the most appropriate design to guide doll D in a hula dancing path. Three or four turning paths would provide a circular rolling movement. Six or more turning paths would provide unexpected dancing paths without repeating the same hula dancing path. With more turning paths, there will be incomplete turns and possibly result in the doll D being caught on the edge of performance base 76. By using a rounded pentagonal (star shaped) performance stage with five turning paths or angles, doll D is provided a unique repeating hula dancing path that improves its movement and turns and avoids boring circular rolling paths. However, any rounded polygonal performance stage may be used if it is deemed desirable to do so.

Figure 11:
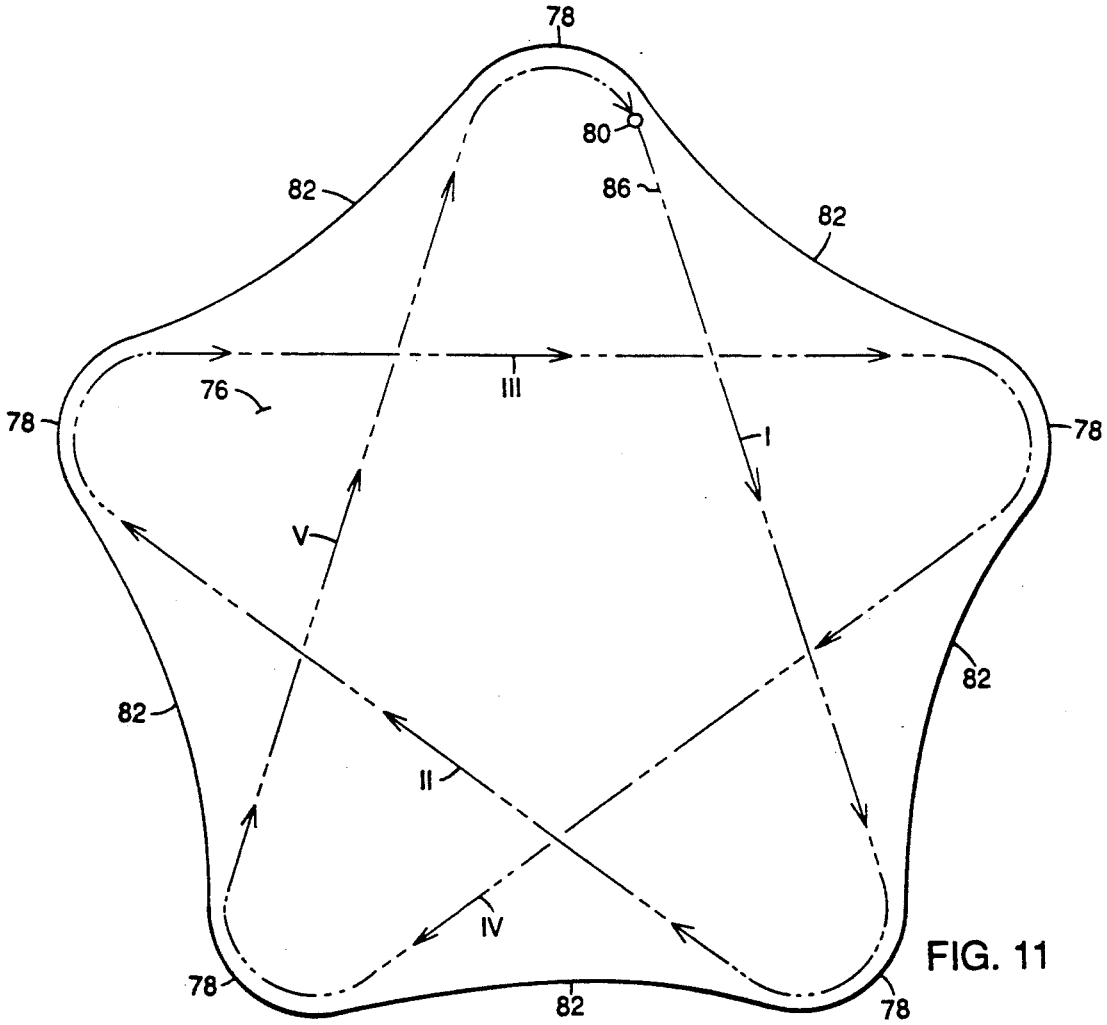
FIG. 11 is an enlarged plan view of the rounded pentagonal performance stage showing the sequential direction of the mobile musical hula dancing doll's movement.

FIG. 11 shows the sequential direction pattern 86 of doll D on a rounded pentagonal (star shaped) performance stage 76 with five turning paths or angles 78 and five blended areas 82. Doll D starts at starting point 80 and proceeds along path I, turns onto path II, proceeds along path II, turns onto path III, proceeds along path III, turns onto path IV, proceeds along path IV, turns onto path V, proceeds along path V to starting point 80. The arrows show the direction of movement of doll D.

Motor drive and gear assembly G includes the mechanical drive train for hip movement and mechanical drive train for forward and turning motions. See FIGS. 9*a* and 9*b*.

The mechanical drive train for hip movement (see FIG. 9*a*) includes motor 47, motor drive gear 46, shaft 44, space gear 42, transfer gear 40, shaft 38, upper transfer gear 36, lower transfer gear 34, shaft 32, transfer drive gear 30, cam drive gear 28, cam shaft 26, cam 24, push rod head 22, spring 20, support sleeve 18, push rod 16, rack gear 14, hip gear 8, and hip shaft 10.

When power is turned on by switch 66, doll D becomes a hula dancer. Motor 47 turns motor drive gear 46, which then turns spacer gear 42. Spacer gear 42 turns transfer gear 40, which then turns shaft 38. Shaft 38 turns upper helical transfer gear 36, which then turns lower helical transfer gear 34. Lower helical transfer gear 34 turns shaft 32 which then turns transfer drive gear 30. Transfer drive gear 30 turns cam drive gear 28, when then turns cam shaft 26. Cam shaft 26 turns cam 24. When cam 24 reaches its highest position, it squeezes spring 20 and pushes push rod 16 and rack gear 14 vertically upward. The upward movement of rack gear 14 causes hip gear 8 to rotate counterclockwise approximately 30 to 45 degrees around hip shaft 10, which causes the right hip 6 of doll D to move to its upward position.

When cam 24 rotates to its lowest position, the squeezed spring 20 expands and pushes the push rod head 22 vertically downward, causing push rod 16 and rack gear 14 to move vertically downward. The vertically downward movement of rack gear 14 causes hip gear 8 to rotate clockwise approximately 30 to 45 degrees around hip shaft 10, which causes the left hip 6 of doll D to move to its upward position.

The mechanical drive train for forward and turns motions (see FIG. 9*b*) includes motor 47, motor drive gear 46, drive wheel gear 54, shaft 50, turning drive wheel 52, axle drive gear 48, axle 56, rear drive wheel 58*a*, rear free moving wheel 58*b*, front wheels 60, and axle 62.

When power is turned on by switch 66, motor 47 turns motor drive gear 46, which then turns drive wheel gear 54. Drive wheel gear 54 turns axle drive gear 48 and shaft 50. Axle drive gear 48 turns axle 56, which turns rear drive wheel 58*a* and rear free moving wheel 58*b*. Shaft 50 turns turning drive wheel 52. When doll D is engaged in forward motion, turning drive wheel 52 is in its free wheeling position. When doll D is engaged in a turning motion, front wheels 60 either go off the edge or they are suspended over a depression on a flat surface, then doll D will tilt forward placing turning drive wheel 52 on the surface. This allows turning drive wheel 52 to make its turn, which causes front wheels 60 to move back on to a surface to continue its forward movement. Front wheel tapers 61 allows front wheels 60 to make a smooth turn. The upper end of the lower slope of front wheel tapers 61 must be equal to or greater than the distance measured from a flat surface to the lowest point of turning driving wheel 52, while it is in a free wheeling position. (See FIG. 7) If the height of the former is less than the height of the latter, there will be a problem in making a turn because front wheels 60 will be caught by the encountered edge. When the height of the former is equal to or greater than the height of the latter, the front wheel tapers 61 allows front wheels 60 to climb up and back on the surface. Turning drive wheel 52 is tapered in order to provide a stop for the forward motion of doll D and to provide the maximum contact area to the surface. Turning drive wheel 52 may be made of rubber to create higher friction to make turns more efficient.

The maximum friction created by the contact of tapered turning drive wheel 52 and the surface turns doll D in the right direction is centered by rear drive wheel 58*a* at radius R, which is measured from turning drive wheel 52 to rear drive wheel 58*a*. See FIG. 9*b*.

The operation of my invention is as follows: When power is turned on by switch 66, doll D becomes a hula dancer. Hawaiian music is heard and motor 47 is turned on. Motor 47 and motor drive and gear assembly G cause hips 6 of doll D to be alternately moved left and right and doll D to move forward. When front wheels 60 go on an edge of a flat surface, turning drive wheel 52 contacts the flat surface and turns front wheels 60 away from the edge and back onto the flat surface.

When doll D is placed at starting point 80 of performance stage 76 prior to turning switch 66 on, doll D will follow in sequence the five paths, I–V, shown on FIG. 11.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. A dancing doll comprising: a body portion, a hip portion, a base portion, means to alternately move the hip portion in a left and right direction; and means to make forward and turning motions; the body portion resembling the head through waist of a human; the hip portion resembling the hip portion of a human; a support post supporting the body portion and the hip portion above the base portion, an end of said support post secured to the base portion and the other end of said support post located in a socket near the head of the body portion; said base portion including a housing, a base, a switch, a speaker, a melody I. C., a battery, two front wheels rotatably connected to an axle, two rear wheels rotatably connected to another axle, a turning drive wheel and a motor; the two front wheels, the two rear wheels and the turning drive wheel are located near the base; said means to alternately move the hip portion in a left and right direction include the motor, a drive gear, a cam, a push rod with a head, a rack gear, a hip gear, and a hip shaft; said drive gear is connected to a shaft of the motor, said cam is operatively connected to the drive gear, the push rod head is located above the cam and the rack gear is connected to the one end of the push rod, the rack gear is meshed with the hip gear, and the hip shaft is pivotally connected to the hip hear at its middle portion and to the hip portion at its ends; said means to make forward and turning motions include the motor, the drive gear, a drive wheel gear, the turning drive wheel, a shaft, an axle drive gear, the two rear wheels rotatably connected to the axle, the two front wheel rotatably connected to the other axle; said drive gear is operatively connected to the drive wheel gear, the drive wheel gear is connected by the shaft to said turning drive wheel, said drive wheel gear is meshed with the axle drive gear, and the axle drive gear is pivotally connected to the axle of the rear wheels; and wiring that connect the switch, the speaker, the melody I. C. and the motor to the battery.

2. The dancing doll of claim 1, wherein said front wheels and said turning drive wheel are tapered; the upper end of the lower slope of the tapers of said front wheel being at least equal to the clear space of said turning drive wheel from a flat surface.

3. The dancing doll of claim 2, wherein a performance stage is used with the dancing doll; the performance stage includes a pentagonal platform with five angles, blended areas between the angles; and a foot beneath each of the angles; the angles being rounded, the radius of the angles being equal to the radius of the turning drive wheel, and the height of the edges of the performance stage being greater than the clear space of said turning drive wheel from a flat surface.

* * * * *